United States Patent [19]

Albertson et al.

[11] Patent Number: 4,723,497

[45] Date of Patent: Feb. 9, 1988

[54] SAILCRAFT UPRIGHTING DEVICE AND METHOD FOR ITS USE

[76] Inventors: Edward Albertson; Richard K. Albertson, both of 1070 W. Ocean View Ave., Norfolk, Va. 23503

[21] Appl. No.: 845,534

[22] Filed: Mar. 28, 1986

[51] Int. Cl.[4] ..... B63B 1/12

[52] U.S. Cl. ..... 114/39.1; 114/61

[58] Field of Search ..... 114/39.1, 61, 121, 124, 114/89, 90, 97, 98

[56] References Cited

U.S. PATENT DOCUMENTS

| | | | |
|---|---|---|---|
| 3,630,163 | 12/1971 | Williams | 114/39.1 |
| 3,996,874 | 12/1976 | Winch | 114/39.1 |
| 4,030,436 | 6/1977 | Stoberl | 114/39.1 |
| 4,102,287 | 7/1978 | Ferris | 114/39.1 |
| 4,223,621 | 9/1980 | Berger | 114/39.1 |
| 4,227,474 | 10/1980 | Ullrich | 114/39.1 |
| 4,516,516 | 5/1985 | Methven | 114/39.1 |
| 4,516,518 | 5/1985 | Cate | 114/39.1 |

FOREIGN PATENT DOCUMENTS

| | | | |
|---|---|---|---|
| 3143317 | 5/1983 | Fed. Rep. of Germany | 114/39.1 |

*Primary Examiner*—Joseph F. Peters, Jr.
*Assistant Examiner*—Edwin L. Swinehart
*Attorney, Agent, or Firm*—Parkhurst & Oliff

[57] ABSTRACT

A device and method which permit a single sailor to upright a capsized sailcraft. The uprighting device and method are adaptable for attachment to any size or type of existing sailcraft. A catwalk is stored on the sailing vessel during periods of nonuse, and upon capsizing of the sailcraft a first end of the catwalk is engaged with a side of the capsized sailing vessel before the surface of the water such that the catwalk extends out in cantilever fashion over the surface of the water at a substantially right angle with respect to a deck of the capsized sailing vessel. An operator of the sailing vessel then applies force to a second end of the catwalk thereby leveraging the capsized sailing vessel into an upright position. The catwalk is stored by securing it to a mast of the sailing vessel with cables and a rubber cord, the cables being utilized for attaching the catwalk to the side of the capsized sailing vessel during use. Alternatively, the catwalk is situated for storage in a cross-member on the sailing vessel, and is then attached to the side of the sailing vessel for use by engaging hooks, rotatable catches or pivotable arms on the catwalk with corresponding brackets, braces or support posts on the sailing vessel.

24 Claims, 11 Drawing Figures

FIG. 10
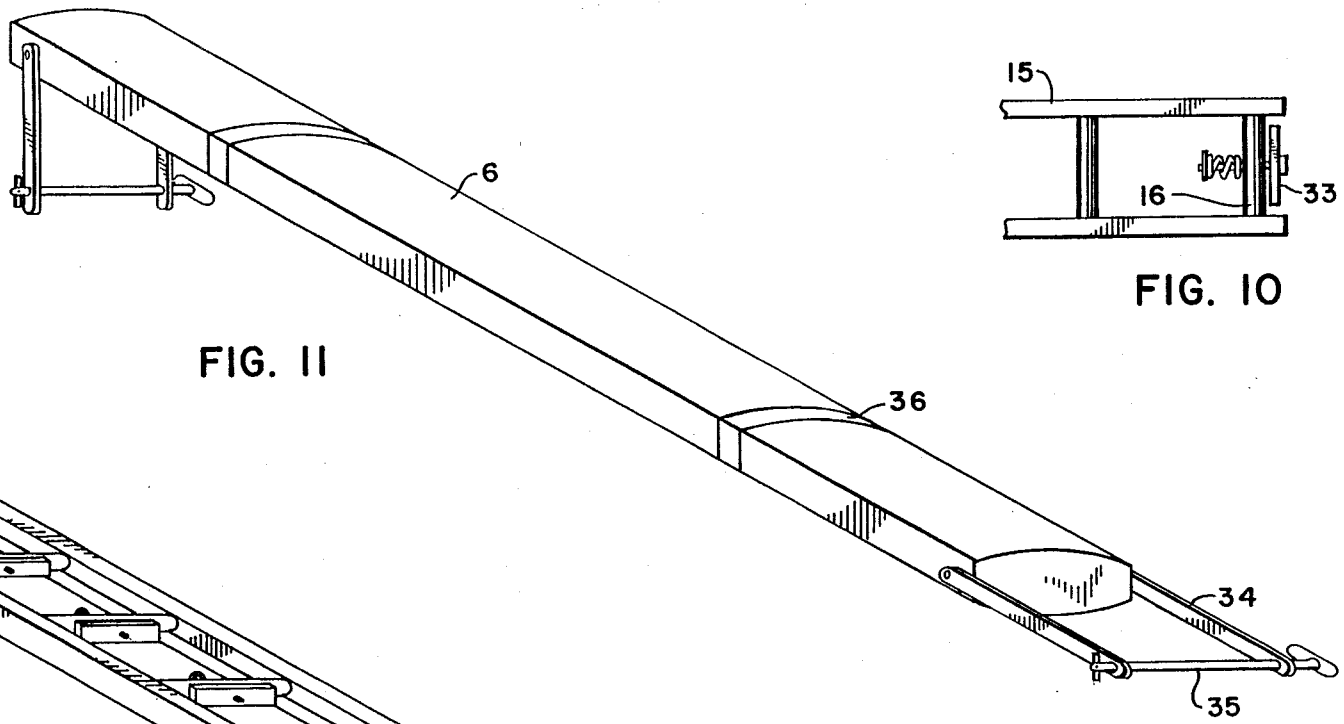
FIG. 11
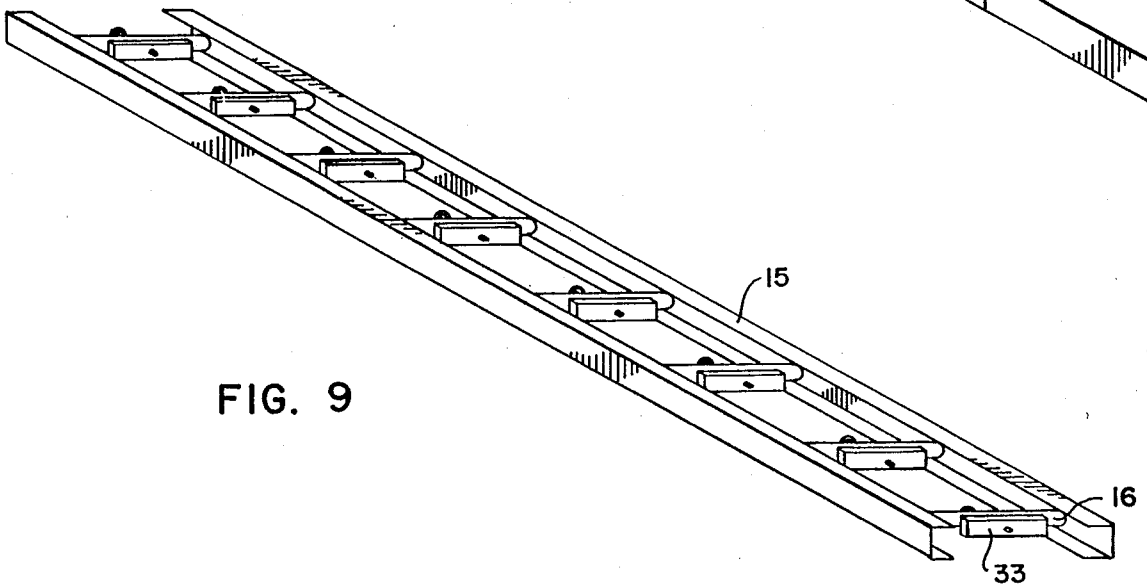
FIG. 9

SAILCRAFT UPRIGHTING DEVICE AND METHOD FOR ITS USE

BACKGROUND OF THE INVENTION

The present invention relates to a device and method for uprighting a capsized sailcraft, and more particularly to a device and method which permit a single sailor to upright a capsized sailcraft, where before at least two people were needed to upright readily the capsized craft. Additionally, the uprighting device and method can be adapted to attach to any size or type of sailcraft without altering its design features.

The capsizing of sailcraft has been occuring for as long as man has sailed. A lone sailor can experience great difficulty in uprighting a small craft, and the task of uprighting a larger craft, such as a 16 or 18 foot catamaran, becomes nearly impossible for a single sailor. Hence, the difficulty associated with a single sailor uprighting a large sailcraft has prevented many sailors from sailing a craft alone because of the fear of capsizing and attendant inability to upright the capsized craft. The long felt need for providing an inexpensive, easily operable and readily attachable apparatus, which permits a lone sailor to upright readily a capsized sailcraft, has never been filled, until the present invention.

Others have attempted the general idea of providing an apparatus for uprighting a capsized craft. For example, U.S. Pat. No. 4,227,474 (Ulrich) provides a catamaran with floodable forecastles as well as buoyancy chambers. However, Ulrich requires a specially designed craft, and the concept of Ulrich clearly cannot be readily transferred to crafts which are already in existence. U.S. Pat. No. 4,223,621 (Berger) discloses another apparatus for uprighting an overturned sailing craft, but necessitates a specially designed sailing craft having pivotal floats to achieve the uprighting of the overturned craft. Hence, Berger also cannot be readily adapted to sailing crafts which are already in existence. U.S. Pat. No. 4,102,287 (Ferris) discloses a catamaran having swingable outrigger hulls, rudders and mast. Ferris is similar to Ulrich and Berger in that it relates to a specially designed craft, and the teachings of Ferris cannot be readily transferred to a sailcraft already in existence.

U.S. Pat. No. 3,996,874 (Winch) teaches a trimaran having displaceable floats to improve the stability of the sailing craft and to aid in self-righting the craft. Again, Winch relates to a specially designed craft and its teachings are not readily transferrable to a sailing craft already in existence. U.S. Pat. No. 3,630,163 (Williams) relates to a pontoon craft having a laterally displaceabke deck. Outermost portions of the deck can be laterally displaced and sleeves filled therein, to provide a larger or smaller deck area depending upon an operator's intended use. U.S. Pat. No. 4,030,436 (Stoberl) discloses an outboard folding seat which permits an operator to trim a sailboat by using his body as a counterweight against a force created by the wind.

None of these cited references fulfill the need to provide an apparatus and method which are adaptable readily to any sailcraft already in existence and which permit a lone operator to upright a capsized craft.

SUMMARY OF THE INVENTION

Accordingly, the present invention has been developed to overcome the foregoing shortcomings of conventional sailcraft and to provide an uprighting device, and method for its use, which are readily adaptable to existing sailcraft to permit a lone sailor to upright a capsized craft.

It is therefore an object of the invention to provide an uprighting device and method for its use which can be easily retrofitted to existing sailcraft.

It is yet another object of the invention to provide an uprighting device and method for its use which allow for fast, easy and efficient uprighting of a capsized sailing vessel.

It is still a further object of the invention to eliminate the fear associated with one-man operation of sailcraft, and thereby allow greater and safer use by the sailcraft owner.

Thus, in accordance with one aspect of the present invention, the shortcoming of the prior art are overcome by a sailcraft uprighting device comprising means for leveraging the capsized craft into an upright position, and means for selectively and removably engaging a first end of the leveraging means with a side of the capsized craft above the surface of the water such that the leveraging means extends out in cantilever fashion over the surface of the water at a substantially right angle to a deck of the capsized craft, whereby the craft can be uprighted by applying force to a second end of the leveraging means opposite the first end.

In accordance with another aspect of the invention, the leveraging means comprises a catwalk, the length of which is substantially greater than its width.

In accordance with yet another aspect of the invention, the device includes means for supporting the catwalk against a hull of the capsized sailing vessel during uprighting of the capsized vessel.

In accordance with still another aspect of the invention, the engaging means comprises a cable looped around a mast of the capsized vessel, the cable ends being detachably and adjustably secured to the first end of the leveraging means.

In accordance with still further aspects of the invention, the device further comprises a cross-member within which the leveraging means is laterally displaceable, and the engaging means variably comprises a plurality of spring loaded hooks mounted on the catwalk and engageable with a support bar on the cross-member, a plurality of axially biased pins rotatably mounted on rungs of the catwalk and engageable with first and second braces fixed to the respective ends of the cross-member, or pivotable arms pivotally connected at their first ends to an end of the catwalk and secured to the sailing vessel by a fastener connecting their second ends.

Still further aspects of the invention include means for storing the catwalk during periods of nonuse, by securing the catwalk to the mast with at least one cable in conjunction with a hooked rubber cord, or by situating the catwalk within the cross-member.

Yet still a further aspect of the invention includes a method for uprighting a capsized vessel by utilizing the above-described device.

These and other aspects and advantages of the invention are described in or apparent from the following detailed description of the preferred embodiments.

BRIEF DESCRIPTION OF THE DRAWINGS

The preferred embodiments are described with reference to the drawings, in which:

FIG. 9 is a perspective view of a catwalk attaching means utilized in the embodiment of FIG. 7;

FIG. 10 is a plan view of the catwalk attaching means of FIG. 9; and

FIG. 11 is a perspective view of an alternative catwalk attaching means utilized in the embodiment of FIG. 7.

DESCRIPTION OF THE PREFERRED EMBODIMENTS

Referring to FIGS. 1 to 4 of the drawings, a sailcraft uprighting device constructed in accordance with a first embodiment of the present invention will now be described.

Figure 1:
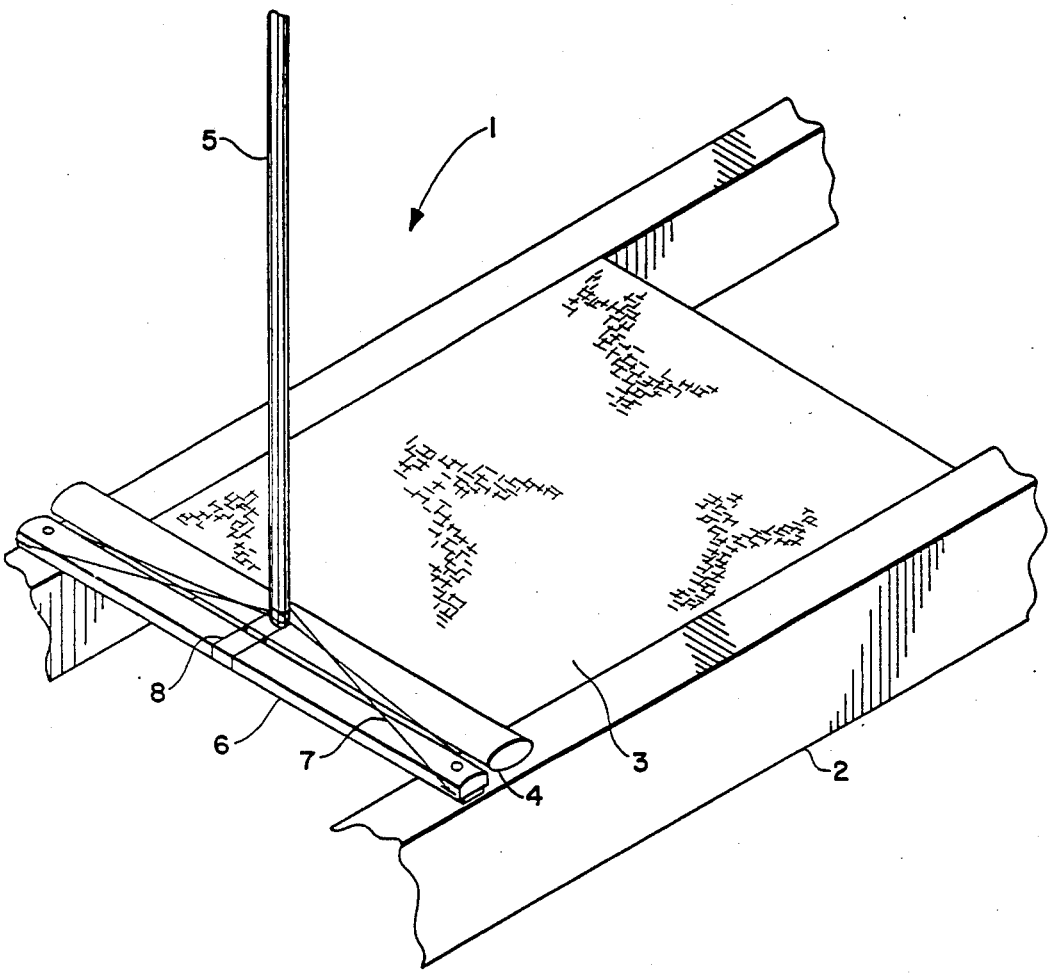
FIG. 1 is a perspective view of a first embodiment of the present invention.

FIG. 1 depicts a sailing vessel 1, including hulls 2, deck 3, cross-bar 4 and mast 5. Stored forward of mast 5 in front of and parallel to cross-bar 4 is catwalk 6, which is secured to mast 5 with two cables 7 and a rubber cord 8 with a hook at each of its ends. Catwalk 6 may alternatively be secured to mast 5 with a single cable 7 in conjunction with a rubber cord 8. Catwalk 6 is preferably made of light-weight metal or fiberglass, or a composite thereof, but can also be made of wood or other light-weight material.

Figure 3:
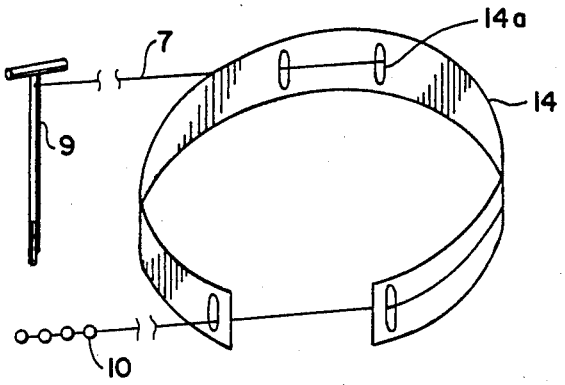
FIG. 3 is an enlarged perspective view of a cable, collar, and bolt arrangement of the embodiment of FIG. 1.
Figure 2:
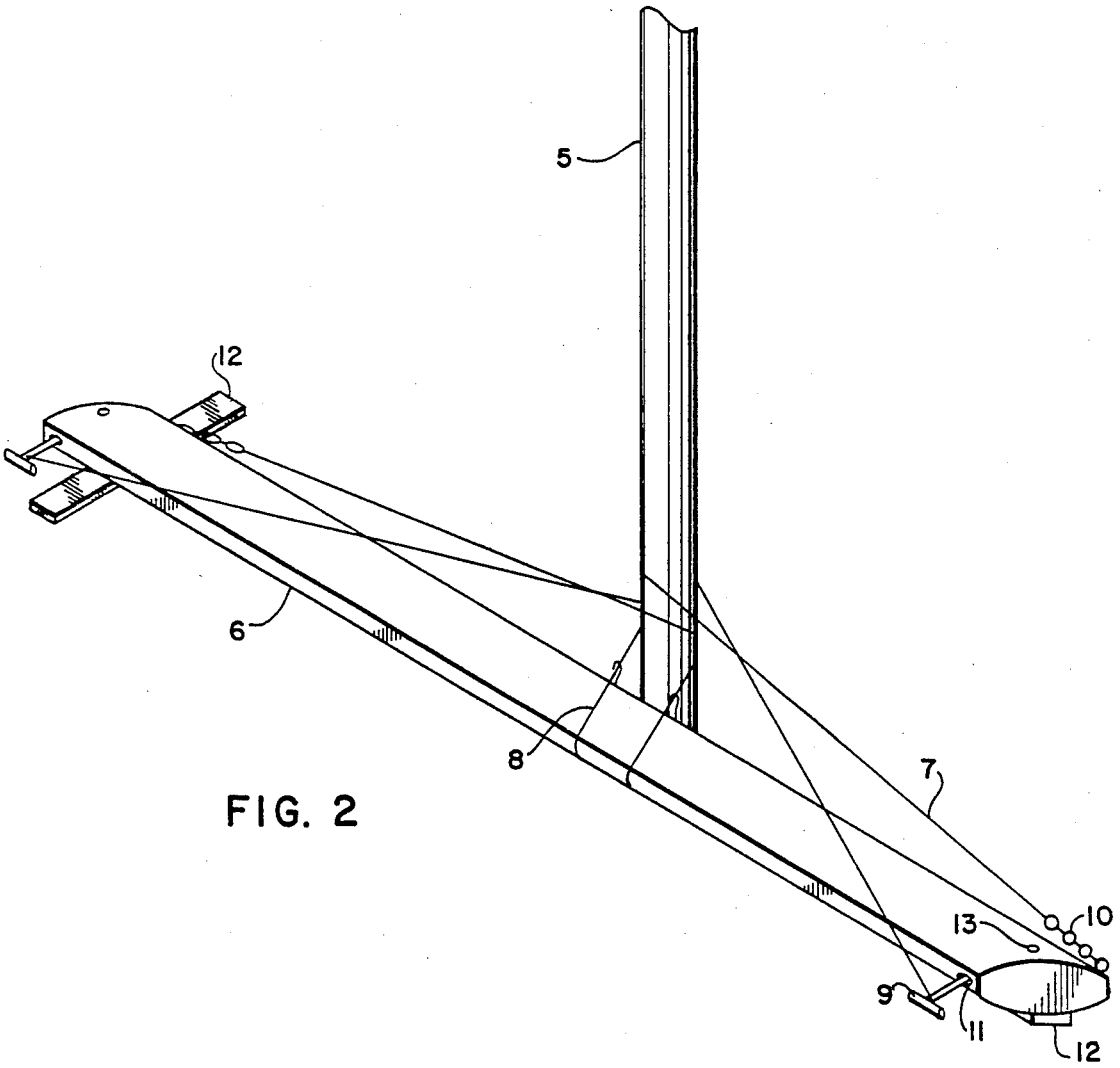
FIG. 2 is an enlarged perspective view of the embodiment of FIG. 1.

As can better be seen in FIGS. 2 and 3, each cable 7 is fixed at one end to a fastener 9, such as, for example, a standard toggle bolt, and has a plurality of eyelets 10 at the other end for receiving fastener 9. In use, cable 7 is looped around mast 5, and then fastened to an end of catwalk 6 by inserting fastener 9 through hole 11 and one of eyelets 10 and securing fastener 9 to prevent unintended disengagement of the cable from the fastener. If a standard toggle bolt is used as the fastener, it can be secured by pivoting its built-in pivotable catch (see FIG. 11). Other types of fasteners can be secured in a known manner. Eyelets 10 provide means for adjusting the effective length of cable 7. In looping cable 7 around mast 5, it is preferable to cross the cable as shown to prevent crossing during use as more fully described below.

It is further preferred that each cable be used in conjunction with a collar 14 as shown in FIG. 3. Collar 14 is wrapped around mast 5, and cable 7 is weaved through holes or slits 14a in the collar. Collar 14 is not only useful in protecting mast 5 and cable 7 and preventing abrasion therebetween, but also prevents cable 7 from being lost overboard when disconnected from catwalk 6 during use as more fully described below. A similar collar or other device, such as a second hooked cord, can also be used to similarly prevent loss of rubber cord 8 when it is disconnected from catwalk 6 during periods of use. Of course, cable 7 and rubber cord 8 can also be used without such as protective collar.

Catwalk 6 is also equipped at each of its ends with a cushioning support or bumper log 12. Cushioning support 12 is pivotally connected to catwalk 6 by means of a fastener 13. Fastener 13 preferably comprises a spring bolt which acts to maintain cushioning support 12 in a given position, but may alternatively comprise a simple bolt around which cushioning support 12 can pivot. When not in use, cushioning support 12 is positioned parallel to catwalk 6 as shown in the right hand side of FIG. 2. When in use, cushioning support 12 is positioned perpendicularly to catwalk 6 as shown in the left hand side of FIG. 2. The use of cushioning support 12 will be more fully described below.

Figure 4:
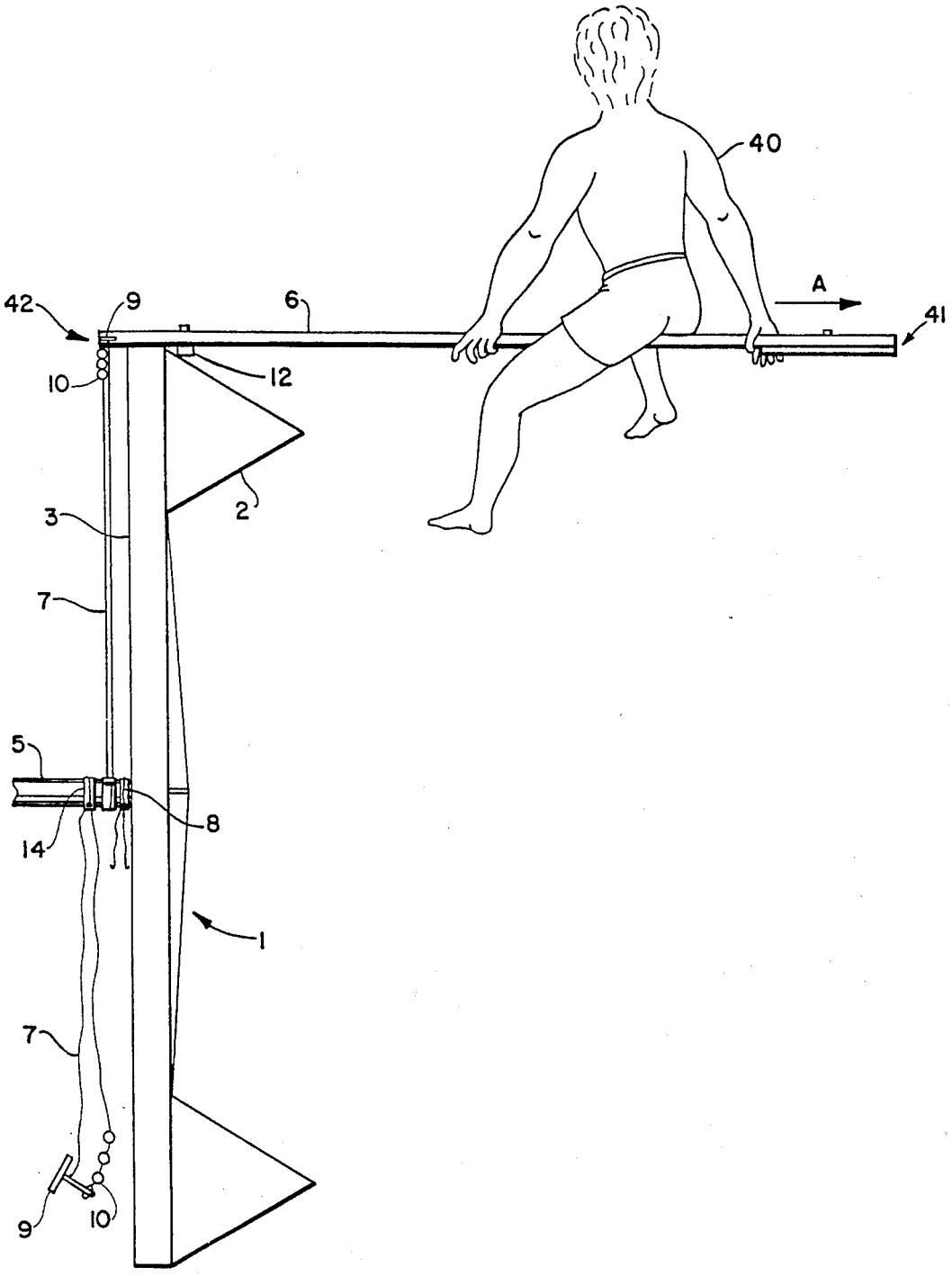
FIG. 4 is a perspective view of the embodiment of FIG. 1 in use.

With reference to FIG. 4, the operation and method of using the uprighting device will now be described. When the sailing vessel 1 capsizes, the operator 40 disconnects from catwalk 6 rubber cord 8 and the cable 7 which is connected to end 41 of catwalk 6 which is farthest from the water. If collars 13 are used, the disconnected cable and rubber cord will not be lost. Catwalk 6 is then pulled up and laid over the hull side into the operative position depicted in FIG. 4. As noted above, if cable 7 was crossed during storage, it will be uncrossed when swung into the operative position. Assuming the proper eyelet 10 was chosen to provide cable 7 with an effective length such that fastener 9 extends approximately one inch beyond the outer side of deck 3 of the sailing vessel, catwalk 6 will form a substantially right angle to the deck with cable 7 taut and cushioning support 12 resting against hull 2. Cushioning support 12 assures proper leveraging of the capsized sailing vessel with catwalk 6 without damage to hull 2 or other parts of the sailing vessel.

Once catwalk 6 is in position, the operator 40 climbs onto catwalk 6 near end 42. The operator then gradually moves in the direction of arrow A toward end 41 of catwalk 6 thereby applying a torque to the capsized vessel causing it to become upright in the water. After uprighting, catwalk 6 is once again stored by reconnecting previously disconnected cable 7 and rubber cord 8 as discussed above.

Figure 6:
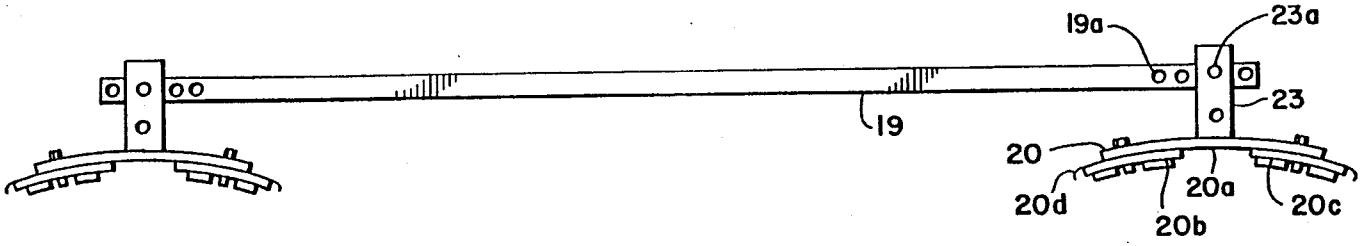
FIG. 6 is a side view of the embodiment of FIG. 5.
Figure 5:
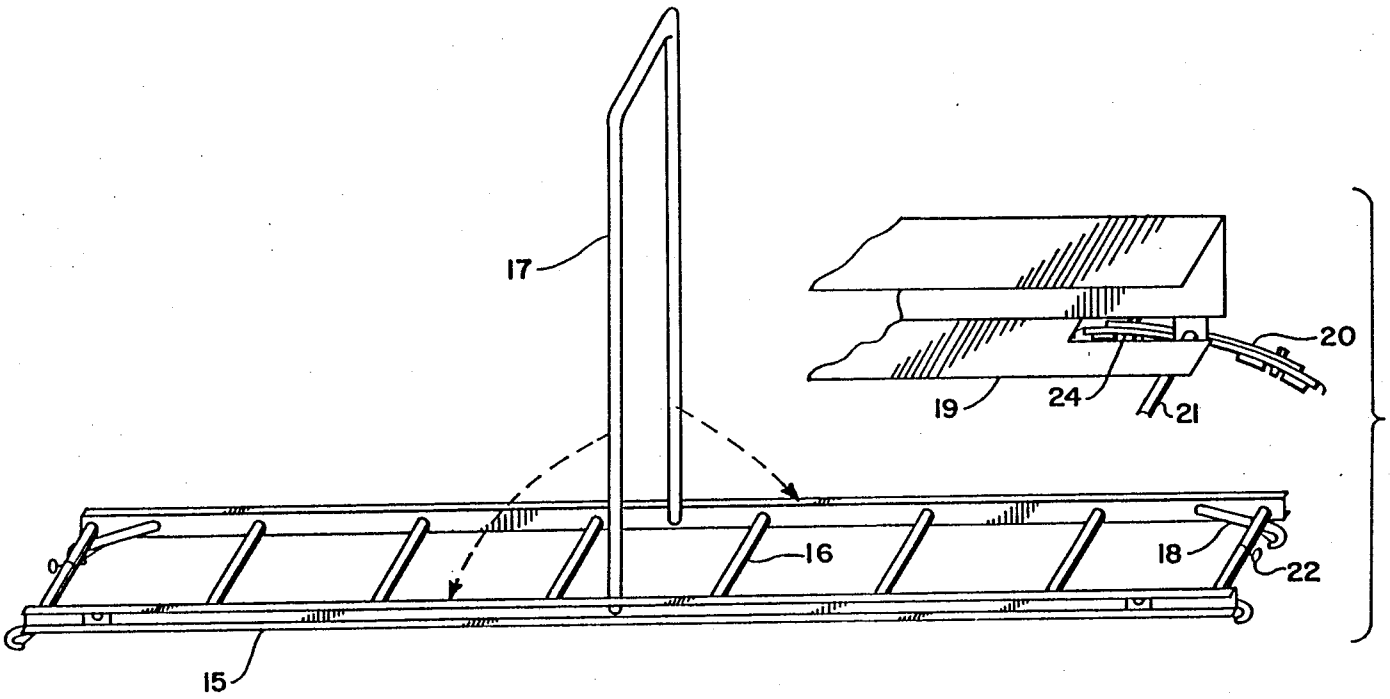
FIG. 5 is a perspective view of a second embodiment of the present invention.

Catwalk 6, the means for engaging catwalk 6 with the side of the capsized sailing vessel during use, and the means for storing catwalk 6 during periods of nonuse, may take other forms, such as for example the forms depicted in FIGS. 5–11. As shown in FIGS. 5 and 6, the catwalk may comprise a ladder-like member 15 with rungs 16 to provide the operator with added gripping capability during use. Catwalk 15 may also include a foldable handle 17 to provide even better gripping capability an to permit the operator to stand on the catwalk during use without falling off. Catwalk 15 in turn may be situated for lateral displacement in tracks 19 (one shown) adjustably mounted to the sailing vessel by means of brackets 20 and 23. Brackets 20 each comprise a series of plates 20*a*, 20*b*, 20*c*, which conform to the contour of the mounting surface and which are adjustable with respect to one another. The bottom plates 20*b*, 20*c* may be equipped with portions 20*d* to grasp the lips of the deck where the hull and deck are joined, or may be attached in the same manner to plates (not shown) installed on the deck of the sailing vessel. Brackets 23 and tracks 19 are each equipped with a series of holes 23*a* and 19*a*, respectively, so that tracks 19 can be adjustably mounted on brackets 20 via brackets 23.

Catwalk 15 may further be equipped with spring-loaded hooks 18 which automatically engage with support bar 21 via slots 24 when catwalk 15 is removed from tracks 19 for use. Catwalk 15 is prevented from becoming unintentionally displaced from tracks 19 by means of cables (not shown) securing hooks 22 to the mast of the sailing vessel. During use, catwalk 15 may be protected against loss through the use of security lines (not shown).

Figure 7:
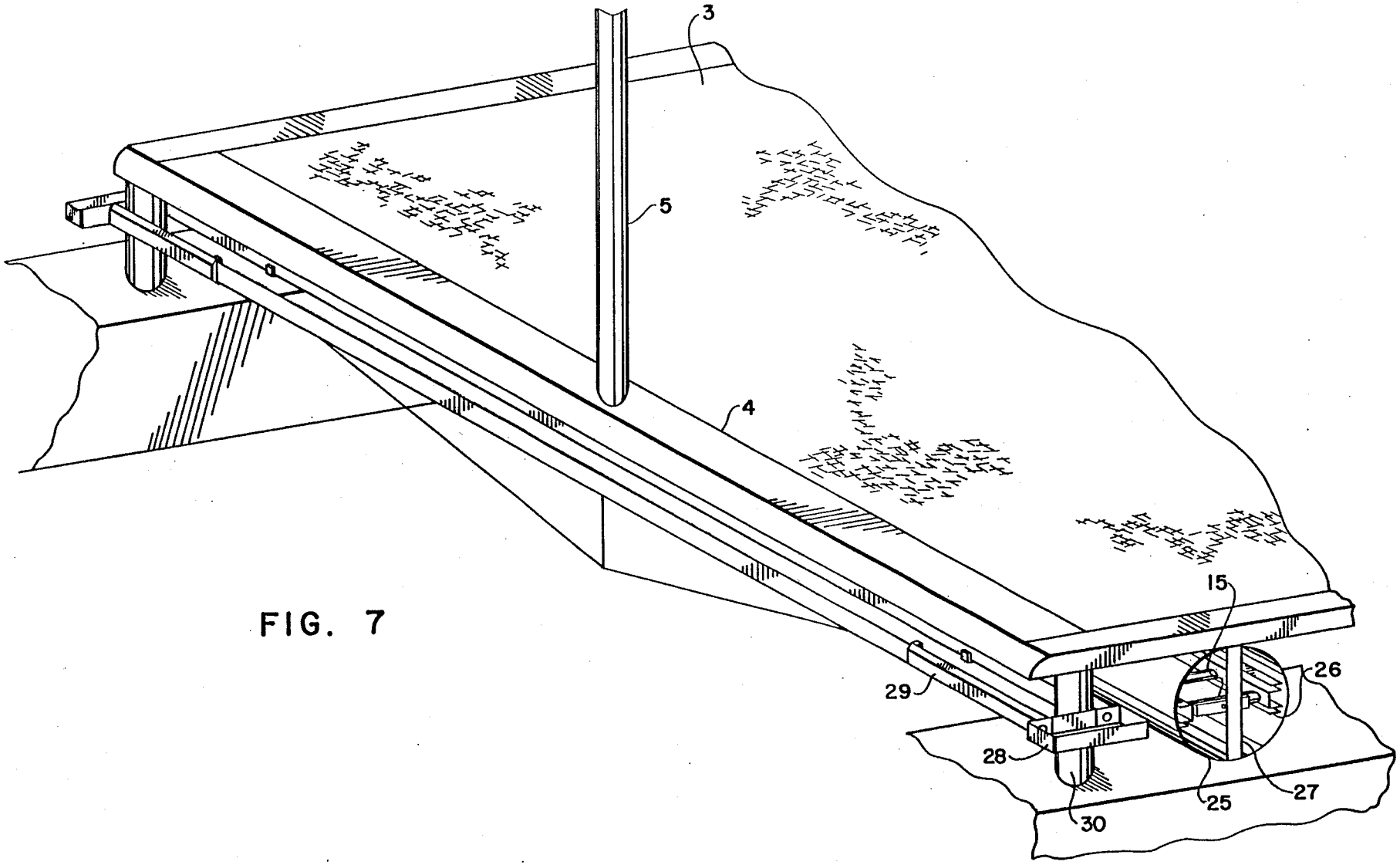
FIG. 7 is a perspective view of a third embodiment of the present invention.
Figure 8:
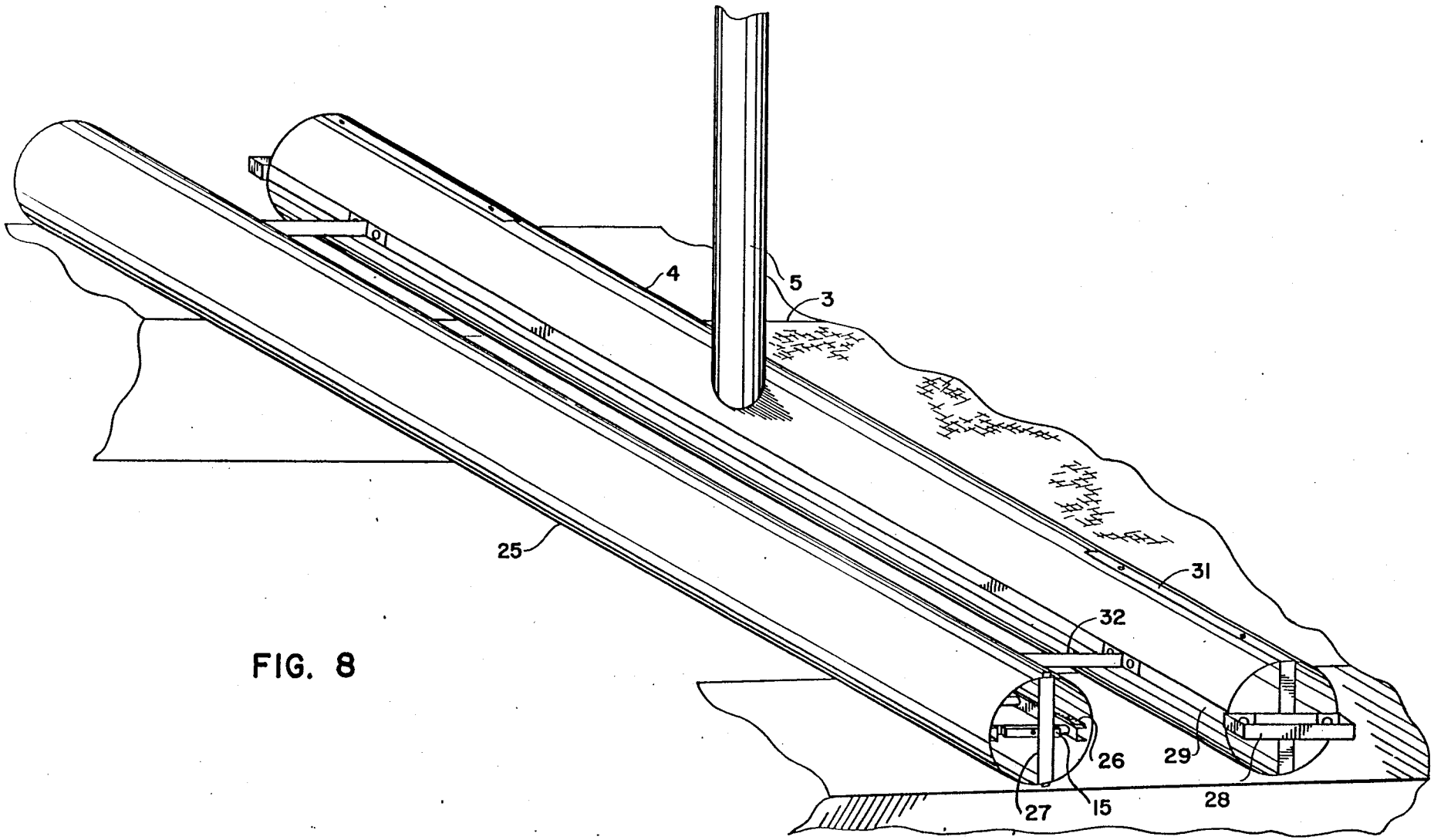
FIG. 8 is a perspective view of an alternative arrangement of the embodiment of FIG. 7.

As shown in FIGS. 7–10, the ladder-like catwalk 15 may be situated for lateral displacement in tracks 26 mounted within a tubular cross-member 25 fixed parallel to cross-bar 4. Tubular cross-member 25 may be mounted behind cross-bar 4 as shown in FIG. 7 with suitable brackets (not shown) to cross-bar 4 and/or deck 3, or may be mounted in front of cross-bar 4 as shown in FIG. 8 with suitable brackets to cross-bar 4 and/or deck 3, such as brackets 32 as shown. Catwalk 15 can be secured in tubular cross-member 25 during periods of nonuse by means of cables as discussed above or by means of rubber cords 27.

In lieu of using cables 7 or hooks 18 to support catwalk 15 during use, catwalk 15 may be supported by a brace 28 mounted to cross-bar 4 and/or deck supports 30 (FIGS. 7 and 8) by means of brackets 29 and 31. During use, catwalk 15 is pulled out of tubular cross-member 25, and the lower end of catwalk 15 is inserted into brace 28. A spring-loaded pivotable catch 33 on catwalk rung 16 is then rotated 90° to prevent catwalk 15 from becoming unintentionally disengaged from brace 28. As shown in FIG. 9, if all of catwalk rungs 16 are equipped with spring-loaded catches 33, the catwalk can be arranged for use at various effective lengths. All of the catches 33 can be mounted on the same side of rungs 16 as shown in FIG. 9, or some of the catches 33 can be mounted on the opposite side of rungs 16. Alternatively, only an outermost rung 16 needs to be equipped with a catch 33, in which case catwalk 15 will always be used at full length.

Where a non-ladder type catwalk is used, the catwalk may be attached during use as depicted in FIG. 11. As shown, catwalk 6 is equipped with pivotable arms 34 which are held parallel to catwalk 6 during periods of nonuse by slideable rubber grommets or sleeves 36. In use, arms 34 are released, are made to straddle deck support poles 30 (FIG. 7), and are held thereto by means of a fastener, such as, for example, a standard toggle bolt 35 with a built-in pivotable catch as shown, connecting the free ends of pivotable arms 34. Alternatively, arms 34 may be secured by fastener 35 to suitable brackets (not shown) arranged in a known manner on the underside of the deck or cross-bar of the sailing vessel.

The embodiments of FIGS. 5-11 are utilized to upright the capsized sailing vessel as described with reference to FIG. 4, except for the use of the alternatively described catwalks, attaching means, and storing means.

In accordance with the above, it can be seen that a sailcraft uprighting device can be constructed, adapted and used to permit a lone sailor to quickly, easily, efficiently and safely upright a capsized sailing vessel. The device and method for its use thus eliminate the fear associated with one-man operation of sailcraft, and increase the sailor's confidence.

Obviously, many modifications and variations to the instant sailcraft uprighting device and method for its use are possible in light of the above teachings. It is therefore to be understood that, within the scope of the appended claims, the invention may be practiced otherwise than as specifically described. For example, the various aspects of the invention may be selected for combination in a number of permutations other than those shown as described. Additionally, the catwalk may be stored at other locations on the sailing vessel, and may be secured in other ways, such as with brackets or tracks of other configurations. Furthermore, during use the catwalk may be engaged with the side of the vessel by merely tying it with rope, cord or cables to the deck support poles or the cross-bar. Finally, other components may be substituted for or added to the variously described brackets, catches, hooks, braces, supports, fasteners, toggle bolts, and other parts of the sailcraft uprighting device.

Thus, while only certain embodiments of the invention have been specifically described herein, it will be apparent that numerous modifications may be made thereto without departing from the spirit and scope of the invention.

What is claimed is:

1. An apparatus for uprighting a capsized sailing vessel having a deck surface which is upwardly facing when said sailing vessel is in an upright position, said apparatus comprising:

means for leveraging the capsized sailing vessel into an upright position; and means for selectively and removably engaging a first end of said leveraging means with a side of the capsized sailing vessel above the surface of the water such that said leveraging means extends out in cantilever fashion over the surface of the water at a substantially right angle with respect to said deck surface of the capsized sailing vessel;

whereby at least one operator of the vessel can upright the capsized sailing vessel by engaging said first end of said leveraging means with a side of the sailing vessel above the surface of the water and by further applying force to a second end of said leveraging means opposite said end thereof.

2. The apparatus of claim 1, wherein said leveraging means comprises a catwalk, the length of which is substantially greater than its width.

3. The apparatus of claim 2, wherein said catwalk is made of light-weight metal.

4. The apparatus of claim 2, wherein said catwalk is made of fiberglass.

5. The apparatus of claim 2, further comprising means for supporting the catwalk against a hull of the capsized sailing vessel during uprighting of the capsized sailing vessel.

6. The apparatus of claim 5, wherein said supporting means comprises first and second cushioning supports pivotally connected respectively to said first and second ends of said catwalk for selective movement into either an operative supporting position perpendicular to said catwalk or an inoperative position parallel to said catwalk.

7. The apparatus of claim 1, wherein said engaging means comprises a cable looped around a mast of said capsized sailing vessel, the cable ends being detachably secured to said first end of said leveraging means.

8. The apparatus of claim 7, wherein said cable ends are secured to said first end of said leveraging means by fastening means extending through a hole in said first end of said leveraging means, and further wherein said cable is fixedly looped around said mast through a collar.

9. The apparatus of claim 8, further comprising means on at least one end of said cable for adjusting the effective length of the cable.

10. The apparatus of claim 7, further comprising means for storing said leveraging means during periods of nonuse.

11. The apparatus of claim 10, wherein said storing means comprises at least one said cable and a rubber cord with a hook at each of its ends, which at least one cable and rubber cord are used to removably secure said catwalk to said mast.

12. The apparatus of claim 1, further comprising a cross-member whose ends are fixed to the outboard sides of the capsized sailing vessel, said leveraging means being situated within and laterally displaceable with respect to said cross-member.

13. The apparatus of claim 12, wherein said cross-member comprises a plurality of substantially parallel tracks.

14. The apparatus of claim 12, wherein said cross-member is tubular, and a plurality of substantially parallel tracks are situated within said tubular cross-member.

15. The apparatus of claim 13, wherein said engaging means comprises a plurality of spring loaded hooks mounted on said catwalk and engageable with a support bar mounted on said cross-member.

16. The apparatus of claim 14, wherein said leveraging means comprises a ladder-like catwalk member having a plurality of rungs, and further wherein said engaging means comprises an axially biased catch rotatably secured to at least one catwalk rung, said catch being engageable with first and second braces fixed to respective ends of said cross-member.

17. The apparatus of claim 14, wherein said engaging means comprises at least two pivotable arms at each end of said catwalk, first ends of said at least two pivotable arms being pivotally connected to an end of said catwalk, and second ends of said at least two pivotable arms being secured to one another by a fastener, whereby said at least two pivotable arms can be made to straddle a portion of said sailing vessel and can be secured thereto with said fastener.

18. An apparatus for uprighting a capsized sailing vessel, said apparatus comprising:

a catwalk, the length of which is substantially greater than its width such that said catwalk is usable to leverage the capsized sailing vessel into an upright position;

first and second cushioning supports pivotally connected respectively to first and second ends of said catwalk for selective movement into either an operative supporting position perpendicular to said catwalk or an inoperative position parallel to said catwalk;

first and second cables fixedly looped around a mast of said capsized sailing vessel through first and second collars respectively, the ends of said first cable being detachably and adjustabley secured to said first end of said catwalk by means of a fastener extending through a hole in said first end of said catwalk, and the ends of said second cable being detachably and adjustably secured to said second end of said catwalk by means of a fastener extending through a hole in said second end of said catwalk; and a rubber cord with a hook at each of its ends looped around said mast and said catwalk;

whereby said capsized sailing vessel can be uprighted by disconnecting the rubber cord from the catwalk, disconnecting the cable from the end of the catwalk which is farthest from the water, selectively and removably engaging to a side of the capsized sailing vessel above the surface of the water the other end of the catwalk to which a cable is still secured such that one of said cushioning supports supports said catwalk against a hull of the capsized sailing vessel and said catwalk extends out in cantilever fashion over the surface of the water at a substantially right angle to a deck of the capsized sailing vessel, and applying force to the end of said catwalk opposite the attached end thereof; and further whereby said catwalk can be stored during periods of nonuse by removably securing the catwalk to the mast with the cables and rubber cord.

19. A method for uprighting a capsized sailing vessel having a deck surface which is upwardly facing when said sailing vessel is in an upright position, said method comprising:

selectively and removably engaging a first end of a catwalk with a side of the capsized sailing vessel above the surface of the water such that said catwalk extends out in cantilever fashion over the surface of the water at a substantially right angle with respect to said deck surface of the capsized sailing vessel; and applying force to a second end of said catwalk opposite said first end thereof to leverage said sailing vessel into an upright position.

20. The method of claim 19, wherein said catwalk is engaged with the side of the capsized sailing vessel by looping a cable around a mast of the capsized sailing vessel, detachably and adjustably securing the ends of the cable to the first end of said catwalk, and abutting said first end of the catwalk against the side of the capsized sailing vessel with the cable taut.

21. The method of claim 20, further comprising the step of storing the catwalk during periods of nonuse by removably securing the catwalk to the mast with at least one said cable and a rubber cord with a hook at each of its ends.

22. The method of claim 19, wherein said catwalk is stored within a cross-member during periods of nonuse, and further wherein during periods of use said catwalk is laterally displaced with respect to said cross-member to the side of the capsized sailing vessel above the surface of the water, and is engaged with the side of the capsized sailing vessel by engaging spring loaded hooks on said catwalk with a support bar mounted on said cross-member.

23. The method of claim 19, wherein said catwalk is stored within a cross-member during periods of nonuse, and further wherein during periods of use said catwalk is laterally displaced with respect to said cross-member to the side of the capsized sailing vessel above the surface of the water, and is engaged with the side of the capsized sailing vessel by engaging axially biased pins rotatably secured to rungs on said catwalk with first and second braces fixed to respective ends of said cross-member.

24. The method of claim 19, wherein said catwalk is stored within a cross-member during periods of nonuse, and further wherein during periods of use said catwalk is laterally displaced with respect to said cross-member to the side of the capsized sailing vessel above the surface of the water, and is engaged with the side of the capsized sailing vessel by straddling a portion of the sailing vessel with at least two pivotable arms pivotally connected at first ends thereof to an end of said catwalk, and securing second ends of said at least two pivotable arms to one another with a fastener.

* * * * *